US009109457B2

(12) United States Patent
Ahaus et al.

(10) Patent No.: US 9,109,457 B2
(45) Date of Patent: Aug. 18, 2015

(54) AXIAL LOCKING SEALS FOR AFT REMOVABLE TURBINE BLADE

(75) Inventors: Guido Ahaus, Essen (DE); Axel Buschmann, Essen (DE); Harald Hoell, Wächtersbach (DE); Peter Schroeder, Essen (DE)

(73) Assignee: SIEMENS ENERGY, INC., Orlando, FL (US)

( * ) Notice: Subject to any disclaimer, the term of this patent is extended or adjusted under 35 U.S.C. 154(b) by 608 days.

(21) Appl. No.: 13/220,760

(22) Filed: Aug. 30, 2011

(65) Prior Publication Data

US 2012/0057980 A1 Mar. 8, 2012

Related U.S. Application Data

(60) Provisional application No. 61/380,050, filed on Sep. 3, 2010.

(51) Int. Cl.
*F01D 11/00* (2006.01)
*F01D 5/30* (2006.01)

(52) U.S. Cl.
CPC ..... *F01D 5/3015* (2013.01); *F01D 11/006* (2013.01); *F05D 2230/70* (2013.01); *Y10T 29/49318* (2015.01)

(58) Field of Classification Search
CPC ..... F01D 11/00; F01D 11/001; F01D 11/006; F01D 5/3015; F05D 2230/70
USPC ..... 416/219 R, 220 R, 221
See application file for complete search history.

(56) References Cited

U.S. PATENT DOCUMENTS

| | | | | |
|---|---|---|---|---|
| 2,972,470 | A | 2/1961 | McCormick | |
| 3,853,425 | A * | 12/1974 | Scalzo et al. | 416/95 |
| 4,648,799 | A * | 3/1987 | Brown et al. | 416/95 |
| 5,816,776 | A * | 10/1998 | Chambon et al. | 415/174.5 |
| 8,128,373 | B2 * | 3/2012 | Webb | 416/220 R |
| 2006/0239822 | A1 * | 10/2006 | Wulf | 416/220 R |
| 2008/0181767 | A1 | 7/2008 | Brillert | |
| 2009/0116965 | A1 | 5/2009 | Brillert | |
| 2010/0047073 | A1 * | 2/2010 | Bluck et al. | 416/220 R |
| 2010/0166563 | A1 * | 7/2010 | Wunderle et al. | 416/219 R |
| 2010/0196164 | A1 * | 8/2010 | Liotta et al. | 416/220 R |
| 2011/0200448 | A1 * | 8/2011 | Elliott et al. | 416/96 R |

FOREIGN PATENT DOCUMENTS

| | | | |
|---|---|---|---|
| EP | 0609979 | A1 | 8/1994 |
| EP | 1657404 | A1 | 5/2006 |
| EP | 1905955 | A1 | 4/2008 |

* cited by examiner

*Primary Examiner* — Dwayne J White
*Assistant Examiner* — William Grigos

(57) ABSTRACT

A turbine blade rotor assembly provides sealing for the rotor components and bi-direction axially locking of the blades on the rotor using a seal plate on the aft exhaust side without axial locking on the forward intake side of the rotor and blade array. As a result, the blades can be removed from the aft direction without moving a turbine casing.

5 Claims, 1 Drawing Sheet

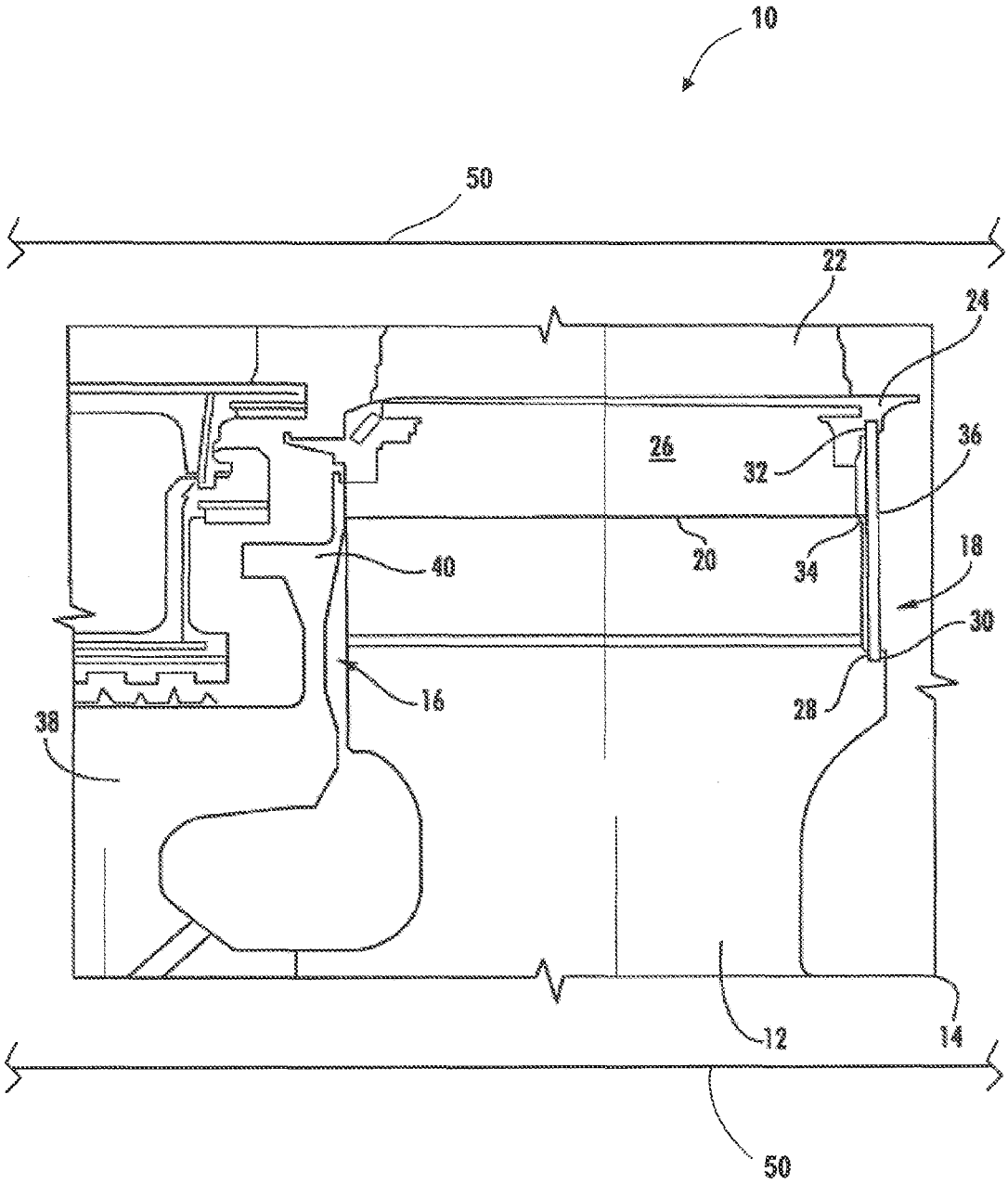
10
50
22
24
26
32
36
20
34
18
40
30
16
28
38
12
14
50

AXIAL LOCKING SEALS FOR AFT REMOVABLE TURBINE BLADE

CROSS-REFERENCE TO RELATED APPLICATION

This application claims priority to U.S. provisional application No. 61/380,050, filed on Sep. 3, 2010, in its entirety.

FIELD OF THE INVENTION

The invention generally relates to turbine engines and, more specifically, to a system and method for axially securing and sealing turbine blade assemblies.

BACKGROUND OF THE INVENTION

In a turbine engine, the turbine section includes a rotor. A plurality of discs are provided on the rotor; the discs are axially spaced from each other. A plurality of blades are mounted on each disc to form a row of blades. The blades are arrayed about the periphery of the disc and extend fan outward therefrom.

Along the axial direction of the turbine, rows of blades alternate with rows of stationary airfoils or vanes. Unlike the blades, the vanes are attached at a radially outer end to a turbine casing and extend radially inward therefrom to a radially inner end. Because the rows of stationary airfoils and the rows of rotating airfoils are spaced from each other, there are axial gaps between these components.

Hot gases from the combustor section of the engine are directed to the turbine section where they engage the vanes and blades, causing rotation of the blade fans and the rotor. The blades and vanes are designed to withstand the high temperature of the combustion gases. In contrast, the radially inner components, such as the discs, can fail if exposed to the hot combustion gases. Accordingly, these components must be protected from the hot combustion gases.

The discs can be shielded from the hot gases by seal plates that are secured to the discs. The major function of the rotor seal plates in the turbine section is to separate the hot gas path from the blade carrying structure, i.e. from the disks. Among many other design requirements, the seal plates also lock the blades into position axially. This axial locking of a turbine blade is typically realized by seal plates on both the forward, intake side and the aft, exhaust side. Each of these seal plates axially locks the blade to one direction. This functional split prevents turbine blades from being disassembled in an enclosed engine because the intake seal plate cannot be accessed unless the turbine casing is lifted. As a consequence, the turbine casing cover needs to be disassembled if a stage 4 blade exchange becomes necessary, creating tremendous work and time effort, potentially leading to increased outage times.

SUMMARY OF THE INVENTION

It is an object of the invention to axially secure the blade array on a rotor disc while allowing the blades to be removed without removing the turbine casing.

Embodiments of the present invention functionally integrate the axial locking of the blades to just the exhaust side seal plate of the turbine blade array. Because the exhaust side is accessible with a closed turbine casing, the seal plates and turbine blades can be disassembled without a lift. This methodology can reduce significantly the effort for a blade exchange.

According to aspects of the invention, a turbine blade rotor assembly includes a rotor disk having an axis of rotation and extending axially from a forward, intake side to an aft, exhaust side. The rotor disk provides an axially extending disk grooves spaced about its circumference. The blade root of each turbine blade is a fanned array is axially mounted in one of said disk grooves.

The rotor disk provides adjacent its aft, exhaust side a radially outward facing circumferential groove. The rotor disk also provides an inner tappet next to the groove.

Each of the turbine blades also provides a circumferential groove along its blade platform facing the circumferential groove of the rotor disk. The blade roots each provide an outer tappet.

Along the aft side the assembly, a number of seal plates are mounted in the grooves. Each plate has an outer edge mounted in at least one of the turbine blade circumferential grooves, and each plate having an inner edge mounted in rotor disk circumferential groove.

The collection of seal plates collectively lock the turbine blades from axial movement by engagement with the inner and outer tappets, whereby the blades are axially secured from the aft, exhaust side and can be removed from the aft, exhaust side without the need to lift the turbine casing.

The seal plates axially lock the blades against travel towards the forward intake side via the circumferential grooves of the platforms to the seal plates until the seal plates engage the rotor disk. The seal plates axially lock the blades against travel towards the aft exhaust side via contact between the blade root tappets and the seal plates which are retrained by the rotor disk circumferential groove.

According to aspects of the invention, each blade root and platform are unrestrained from rearward axial movement by any structure on their forward intake side. A spacer disk positioned on the forward, intake side of the rotor disk can provide a radially extending sealing arm for engaging the blade root of at least one of the turbine blades without axially restricting the blade roots or their associated blades.

The assembly is surrounded by a turbine casing that does not have to be moved to remove the blades. This feature is particularly suitable to a stage 4 turbine blade assembly.

This assembly allows a method of removal in which the aft sealing plates can be removed, followed by removal of the blades without any lifting or other movement of the turbine casing.

BRIEF DESCRIPTION OF THE DRAWINGS

The sole FIGURE is a sectional side view of a turbine blade assembly embodiment according to aspects of the invention.

DETAILED DESCRIPTION OF EMBODIMENTS OF THE INVENTION

The present invention is directed to improvements in the sealing of turbine blade rotor assemblies and the axial locking of the blade array in such assemblies. The features of the invention can have application in various blade rows of the turbine section, but are particularly appropriate for stage 4 blade arrays.

Referring to the FIGURE, a turbine blade rotor assembly 10 is shown. The turbine blade rotor assembly 10 includes a rotor disk 12 designed to rotate about an axis of rotation 14 and is oriented axially from a forward, intake side 16 to an aft, exhaust side 18.

The rotor disk 12 provides axially extending disk grooves 20 spaced about its circumference. An array of turbine blades, one blade 22 of which is shown, is mounted on the rotor disk 12 and a turbine casing 50 radially surrounds the array of turbine blades. The turbine blade 22 has an airfoil terminating in a blade platform 24 and blade root 26. The blade root 26 is axially mounted in the disk groove 20.

The rotor disk 12 provides axially extending disk grooves 20 spaced about its circumference. An array of turbine blades, one blade 22 of which is shown, is mounted on the rotor disk 12. The turbine blade 22 has an airfoil terminating in a blade platform 24 and blade root 26. The blade root 26 is axially mounted in the disk groove 20. The rotor disk 12 provides adjacent its aft, exhaust side 18 a radially outward facing circumferential groove 28. An inner tappet 30 or projection is also provided by the rotor disk 12. Correspondingly, the turbine blade 22 provides a circumferential groove 32 along its blade platform 24 axially aligned with and facing the circumferential groove 28 of the rotor disk 12. The blade root 26 can provide an outer tappet projection 34.

A plurality of seal plates, such as the seal plate 36, are mounted along the aft exhaust side 18 of the turbine blade rotor assembly 10. An outer edge of the plate 36 is mounted in the turbine blade platform circumferential groove 32. An inner edge of the plate 36 is mounted in the rotor disk circumferential groove 28.

The seal plate 36 locks the turbine blade 22 from axial movement by engagement with the inner and outer tappets 30, 34 and the grooves 28, 32.

Without restraint, the blade root 26 can move axially in the disk groove 20 and thus needs to be locked to ensure a proper positioning of the blade 22. This axial locking is performed bi-directionally for both directions by the seal plate 36 aft of the assembly 10. Downstream or aft locking is achieved by the blade root tappet 34 contact with the seal plate 36. The axial contact force is transmitted through the seal plate inner edge to the disk groove 28, thus locking the blade 22 in this downstream direction.

Upstream locking is achieved when an upstream movement of the blade platform 24 is transmitted via the circumferential platform groove 32 to the seal plate 36 until the seal plate 36 contacts the disk tappet 30. The contact force is transmitted through the seal plate 36 to the blade platform groove 32, thus locking the turbine blade 22 in the upstream direction.

The described assembly provides a number of advantages. The seal plate is accessibly with a closed turbine casing 50. Exchange of blades for example in the stage 4 array can be performed with a closed turbine casing 50. These abilities can result in improved serviceability and reduced outage time.

According to aspects of the invention, each blade root 26 and platform 24 are unrestrained from rearward axial movement by any structure on their forward intake side 16. A spacer disk 38 positioned on the forward, intake side 16 of the rotor disk 12 can provide a radially extending sealing arm 40 for engaging the blade root 26 of the turbine blade 22 without axially restricting the blade 22.

While detailed of preferred embodiments have been described, it is not intended that the invention be limited to these specifics. Rather, the scope of the invention should be determined by the appended claims.

What is claimed is:

1. A turbine assembly having an array of turbine blades that can be disassembled downstream without removing a turbine casing, the assembly comprising:

a rotor disk having an axis of rotation and extending axially from a forward, intake side to an aft, exhaust side;

said rotor disk having axially extending disk grooves spaced about its circumference;

an array of turbine blades, each turbine blade having an airfoil terminating in a blade platform and blade root;

a turbine casing arranged to radially surround the array of turbine blades;

each blade root being axially mounted in one of said disk grooves;

said rotor disk providing adjacent its aft, exhaust side a radially outward facing circumferential groove adjacent an inner tappet;

each of the turbine blades providing a circumferential groove along its blade platform facing the circumferential groove of the rotor disk;

each of said blade roots providing an outer tappet;

a plurality of seal plates, each plate have an outer edge mounted in at least one of the turbine blade circumferential grooves, each plate having an inner edge mounted in rotor disk circumferential groove;

said plurality of seal plates collectively at the aft, exhaust side of the rotor disk locking the turbine blades from axial movement by engagement with the inner and outer tappets, wherein the blades are axially secured from the aft, exhaust side and can be axially removed from the aft, exhaust side without lifting the turbine casing, wherein each blade root and platform are unrestrained from rearward axial movement by any structure on the forward, intake side of the rotor disk; and a spacer disk positioned on the forward, intake side of the rotor disk, said spacer disk including a radially extending sealing arm effective to engage the blade root of at least one of the turbine blades without axially restraining rearward axial movement of the blade root and platform, wherein said array of blades is removable in the aft, exhaust direction by access just to the aft, exhaust side of the rotor disk without removing or disassembling the turbine casing.

2. The assembly according to claim 1, wherein the seal plates axially lock the blades against travel towards the forward intake side via the circumferential grooves of the platforms to the seal plates until the seal plates engage the rotor disk and wherein the seal plates axially lock the blades against travel towards the aft exhaust side via contact between the blade root tappets and the seal plates which are retrained by the rotor disk circumferential groove.

3. The assembly according to claim 1, wherein the assembly is a stage 4 turbine blade assembly.

4. In a turbine assembly having a rotor disk having an axis of rotation and extending axially from a forward, intake side to an aft, exhaust side;

said rotor disk having axially extending disk grooves spaced about its circumference; an array of turbine blades, each turbine blade having an airfoil terminating in a blade platform and blade root;

each blade root being axially mounted in one of said disk grooves;

said rotor disk providing adjacent its aft, exhaust side a radially outward facing circumferential groove adjacent an inner tappet;

each of the turbine blades providing a circumferential groove along its blade platform facing the circumferential groove of the rotor disk;

each of said blade roots providing an outer tappet;

a plurality of seal plates, each plate have an outer edge mounted in at least one of the turbine blade circumferential grooves, each plate having an inner edge mounted in the rotor disk circumferential groove, said plurality of seal plates at the aft, exhaust side of the rotor disk collectively locking the turbine blades from axial movement by engagement with the inner and outer tappets, and a turbine casing radially surrounding the array of turbine blades, a method for removing an array of turbine blades from the turbine rotor assembly without removing the turbine casing, said method comprising the steps of:

arranging each blade root and platform to be unrestrained from rearward axial movement by any structure on the forward, intake side of the rotor disk;

positioning a spacer disk on the forward, intake side of the rotor disk, said spacer disk providing a radially extending sealing arm for engaging the blade root of at least one of the turbine blades without axially restraining rearward axial movement of the blade root and platform;

releasing the turbine blades for axial rearward movement by removing the seal plates; and axially removing the blades towards the aft, exhaust side direction by accessing just the aft, exhaust side of the rotor disk without removing or disassembling the turbine casing.

5. The method of claim 4, wherein the turbine assembly comprises a stage 4 turbine rotor assembly.

* * * * *